US005595387A

United States Patent [19]

Senna

[11] Patent Number: 5,595,387

[45] Date of Patent: Jan. 21, 1997

[54] TOILET BOWL ARCADE GAME

[76] Inventor: Randall Senna, 1 Rolling Knolls Dr., Middletown, N.J. 07748

[21] Appl. No.: 384,521

[22] Filed: May 12, 1995

[51] Int. Cl.[6] ..... A63B 63/04

[52] U.S. Cl. ..... 273/369; 273/397; 273/381; 273/371

[58] Field of Search ..... 273/354, 355, 273/356, 357, 359, 369, 378, 381, 382, 383, 384, 385, 386, 387, 389, 390, 396, 397, 349, 371

[56] References Cited

U.S. PATENT DOCUMENTS

| | | | |
|---|---|---|---|
| 805,361 | 11/1905 | Hockett | 273/389 |
| 4,109,914 | 8/1978 | Matsumoto | 273/357 |
| 4,215,867 | 8/1980 | Natwick | 273/357 |
| 4,702,480 | 10/1987 | Popeski et al. | 273/385 |
| 4,744,113 | 5/1988 | Kogut | 273/349 |
| 4,826,176 | 5/1989 | Kobayashi | 273/354 |

*Primary Examiner*—Mark S. Graham
*Attorney, Agent, or Firm*—Ira M. Adler, Esq.

[57] ABSTRACT

The invention relates to an arcade type amusement game in which contestants compete to be the first to get a set number of balls in 15, the opening of a replica of a toilet bowl while a toilet-like seat is rising and falling. The invention provides a means of tracking the number of successful balls entering the bowl.

1 Claim, 14 Drawing Sheets

OPERATES CONTROLS
RESET
NORMALLY CLOSED
START
NORMALLY OPEN
POWER SUPPLY
IN 4004
RESET 3PST
START 3PST
IN PLAY #1 3PST
IN PLAY #2 3PST
IN PLAY #3 3PST
IN PLAY #4 3PST
CONTROLS INPLAY
LID ENSOR WHEN LID IS UP
UNIT 1
UNIT 2
UNIT 3
UNIT 4
ELECTRIC VALVES #1+#3

TOILET BOWL ARCADE GAME

BACKGROUND—FIELD OF INVENTION

The invention relates to an arcade type amusement game in which contestants compete to be the first to get a set number of balls in the opening of a replica of a toilet bowl while a toilet-like seat is rising and falling. The invention provides a means of tracking the number of successful balls entering the bowl.

BACKGROUND & DESCRIPTION OF PRIOR ART

Sato, U.S. Pat. No. 1,564,140 describes an amusement game wherein a ball is thrown into a basket, but does not dissolve a rising and falling cover as in the present invention, nor is the target simulative of a toilet bowl. Kideney, U.S. Pat. No. 1,570,632, is a device for catching and throwing balls in the same receptacle. Downey, U.S. Pat. No. 1,339,846, shows a ball game, wherein a ball is thrown into a group of concentric targets, but shows no means of deflecting the projectile.

OBJECT & ADVANTAGES

The object of the invention is a projectile ball based amusement arcade game simulative of a toilet bowl of which the seat rises and falls to deflect the flight of a ball thrown into the bowl by a participant.

DRAWING FIGURES

FIG. 2 is a side section view of one station.

SPECIFICATION

Figure 1:
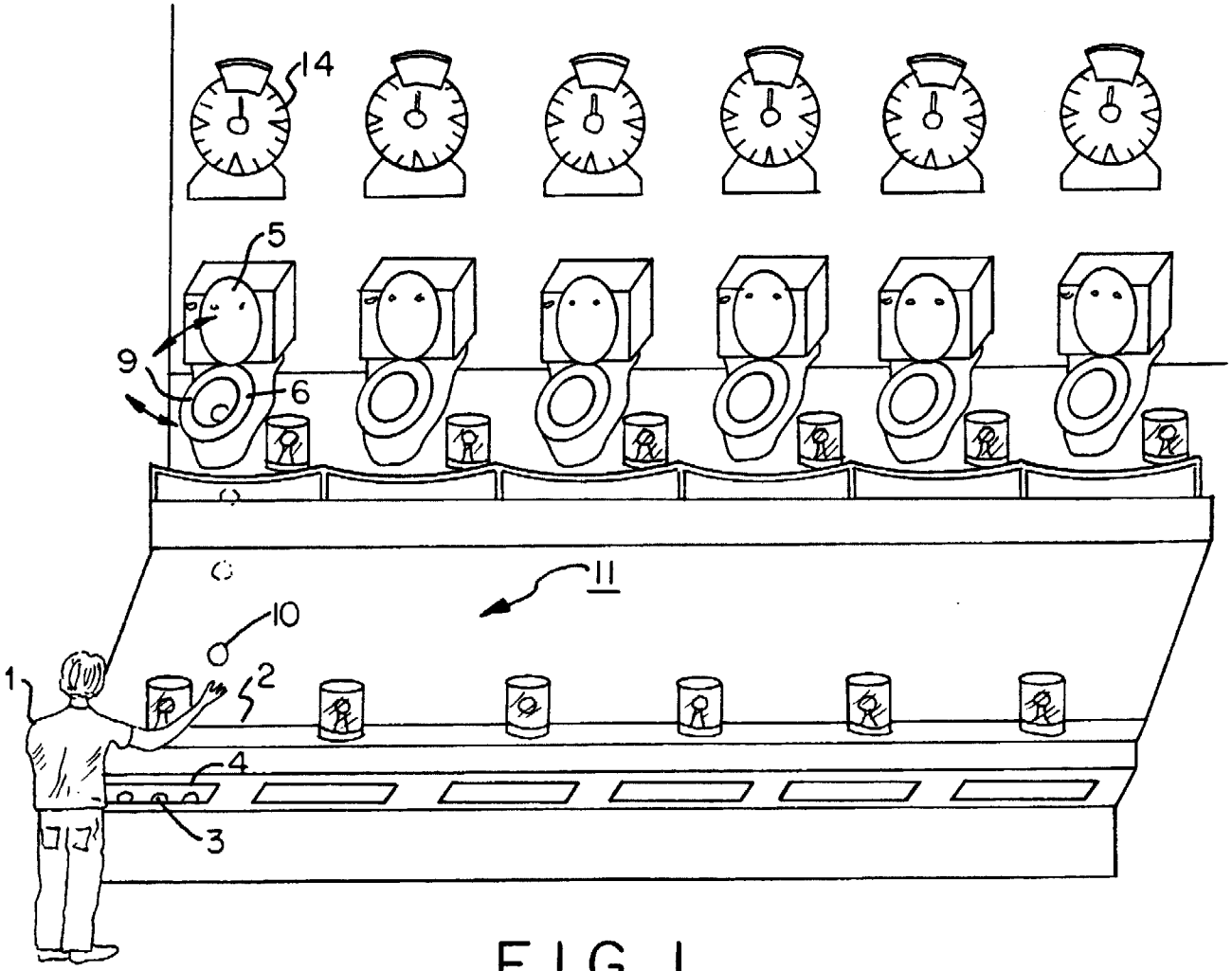
FIG. 1 is a frontal view of the invention showing a multiplicity of game stations.

Typically in the use of the invention, as shown in FIG. 1, each of several contestants, 1, stands in front of a similar station facing a replica of a toilet bowl, 9. When the game is started, each contestant receives a large quantity of balls, 3, from a compartment, 4, which opens when the game is activated for a contestant. Prior to the beginning of the game, a seat cover, 5, is the closed position.

Figures 2A, 2B:
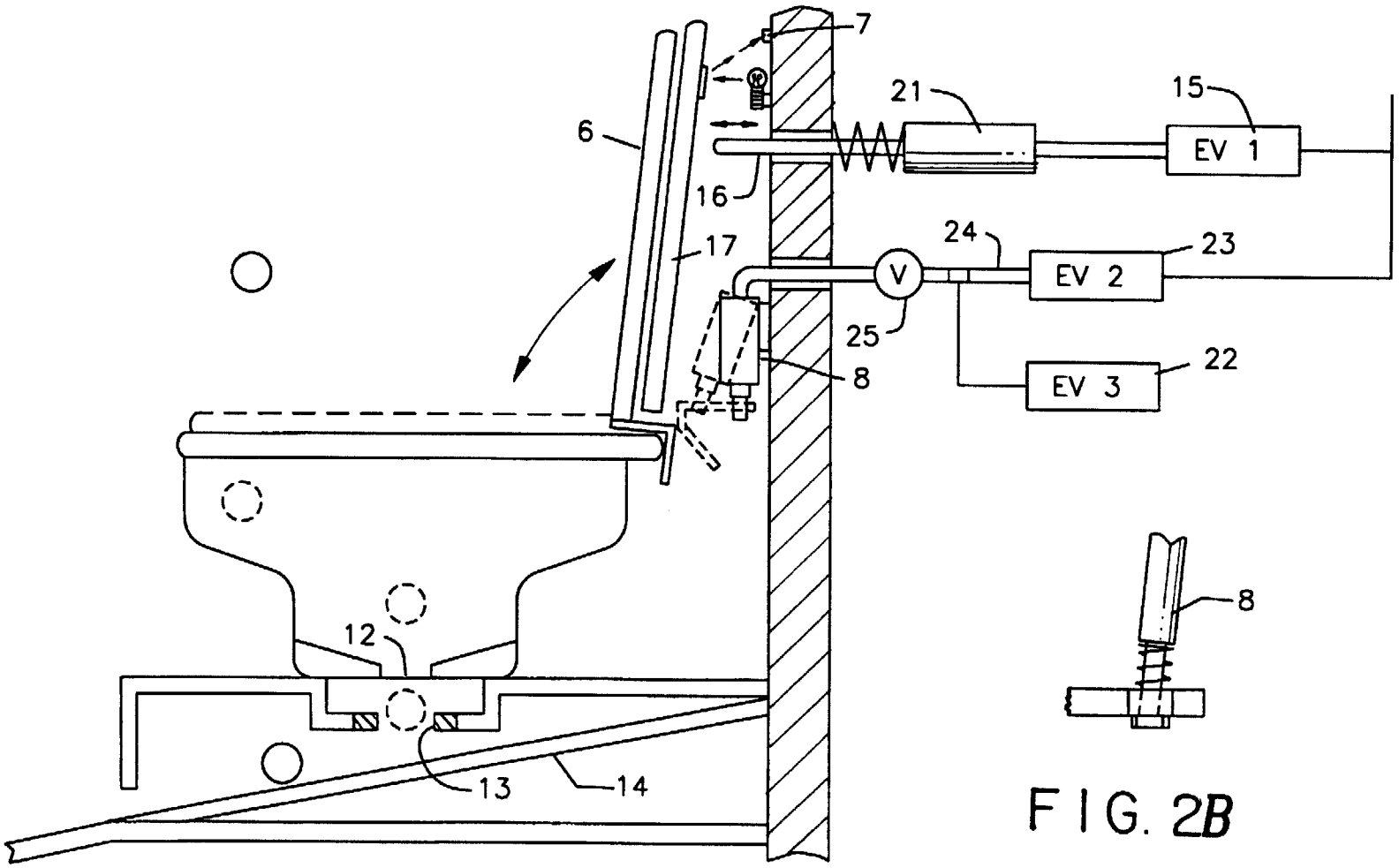
FIG. 2A is a detail view of the seat hinge mechanism.

As in FIG. 2, once a station is occupied by a contestant, the operator raises the cover. A light activated detector, 7, senses that the cover is raised and the station is in play. When the game begins, this causes air solenoids, 8, to alternatively cause a simulated toilet seat, 6, to rise and fall.

In playing the game, as in FIG. 1, the player, 1, aims one or more balls, 10, at the top opening in the replica toilet bowl. Each player receives an unlimited number of balls and can toss as many as they can. The balls fall through a hole in the bottom of the bowl, 12, as in FIG. 2. On exiting the bowl the ball breaks a light beam, 13, causing a signal to sent to a motorized indicator, 14. The balls roll down a ramp to open compartments in front of the contestant. While each player has their own compartment, 4, as in FIG. 1, the balls recycle randomly to the various players as they roll down the ramp, 1. During play, valve 23 is energized, in a sequential manner, through the game circuits, allowing pressurized air to enter line 24, thereby filling cylinder 8, which presses on the lid, 17, causing it to rise. When one of the contestants causes his scoring indicator, 14, to fully rotate by being the first to throw the required number of balls into the bowl, the game ends. The system provides an accompanying audio sound which is activated each time the ball passes through the light beam at the bottom of the bowl.

As shown in FIG. 2, when the game is completed, by the determination of a winner, the score indicator causes a valve, to be energized, causing air to push through a cylinder, 21, which, in turn, pushes a rod, 16, which contacts the back of the seat cover, 17, causing it to fall and close the bowl. At the same time valve 22 is energized, causing any air pressure in cylinder 8 to be eliminated, allowing seat 6 and cover 17, to freely fall. When valve 23 is not energized compressed air in the line, 24, bleeds out of bleeder valve, 25, causing the lid, 17, to slowly fall.

Figure 4:
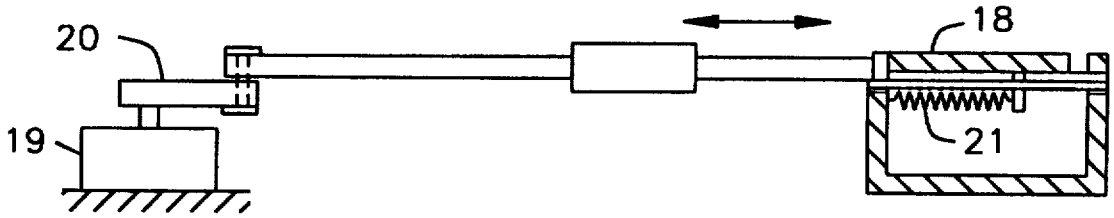
FIG. 4 is a side view of a motorized sliding cover for the ball compartment.
Figure 5:
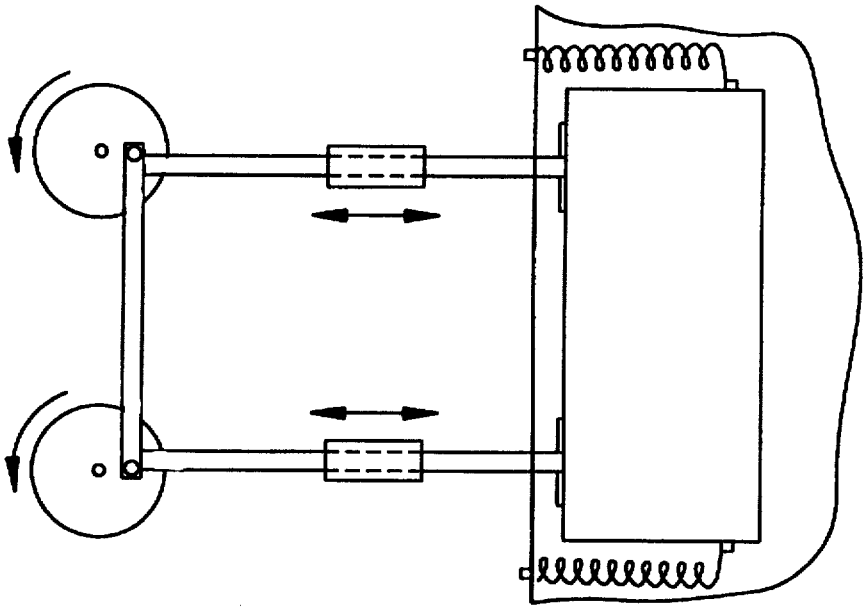
FIG. 5 is a top view of a motorized sliding cover for the ball compartment.

When over, the game is shown as complete on the score indicator, and a motor, 19, rotates cam 20 to its closed position and a spring, 21, slides the ball compartment cover, 18, closed in front of the contestant, as in FIG. 4. A top view of the cover closing mechanism is seen in FIG. 5. The spring closing mechanism is used for safety. When the game is restarted a motorized cam mechanism, 20, causes the cover to open for access to the balls.

Figure 3:
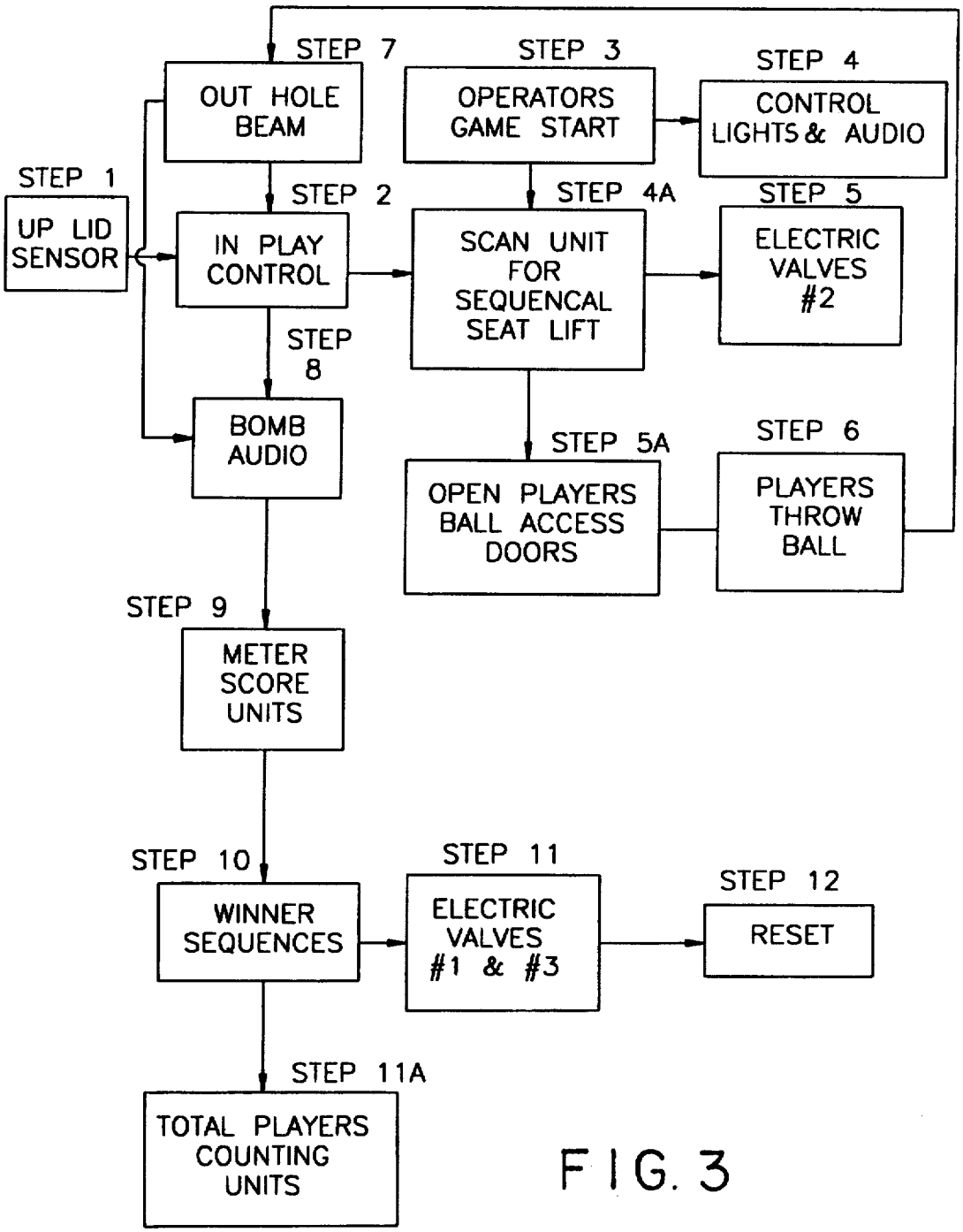
FIG. 3 is a block diagram of the system.

FIG. 3 is a block diagram of the invention. In Step 1, when participants are ready to start the game, the lid is raised and sensed, activating the "in play" controls, Step 2. In Step 3, the operator starts the game, which sequences control lights and audio operation, Step 4, as well as a scan unit which sequences the toilet seat lifting and lowering, as in Step 4A. This sequencing activates an electric valve, Step 5, and opens the play ball access doors, Step 5A. With the door open, the player throws balls, Step 6, into the toilet bowl, attempting to get a ball into the bowl when the seat is raised.

As a ball goes through the bottom of the bowl, the out hole beam is broken, Step 7. If the station is on play, bomb audio is activated, Step 8, and the score unit is updated, Step 9.

When a predetermined number of balls are thrown into a particular bowl, the winner sequences, Step 10, are activated. This causes electric valves #1 and #3 to be energized, Step 1, and reset of the game, Step 12. As the winner sequences are activated, the total players counting unit is updated.

Figure 6A:
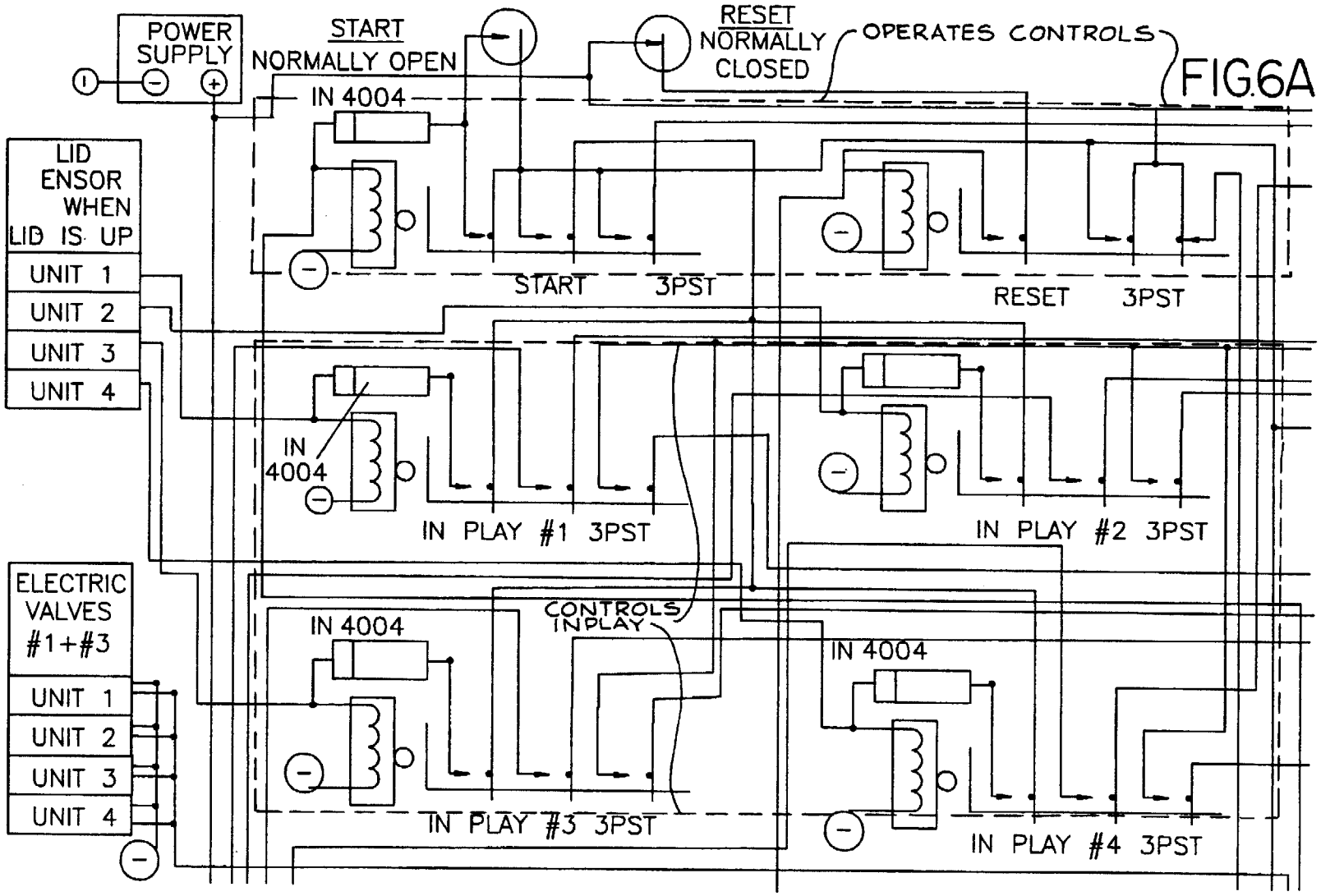
FIGS. 6A to 6H is a detailed wiring diagram of the invention.
Figure 6B:
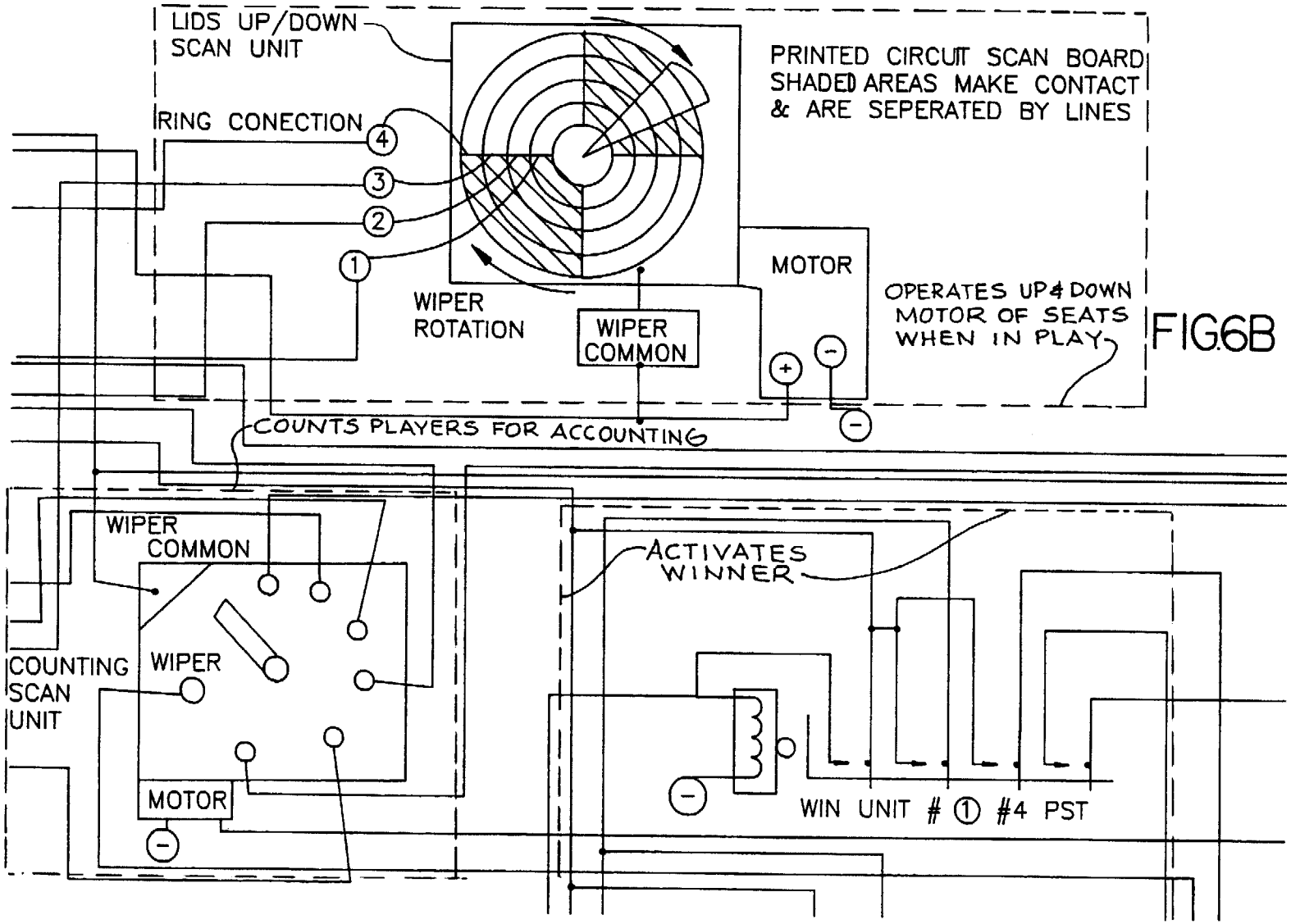

FIGS. 6A to 6G, are diagrams of an embodiment of the circuit of the invention for four players. More or less players may be provided. In FIG. 6A, the raising of the cover plugs the controls "in play". Also shown is the operator start button, which is pushed by the operator to start the game. The "Operator controls" also contain a reset system which resets the Reset Score Meter circuit, shown in FIG. 6G. In FIG. 6B, the circuit is shown which controls the raising and lowering of the seat, when the game is "in play". FIG. 6B also shows the counters for player accounting.

Figure 6C:
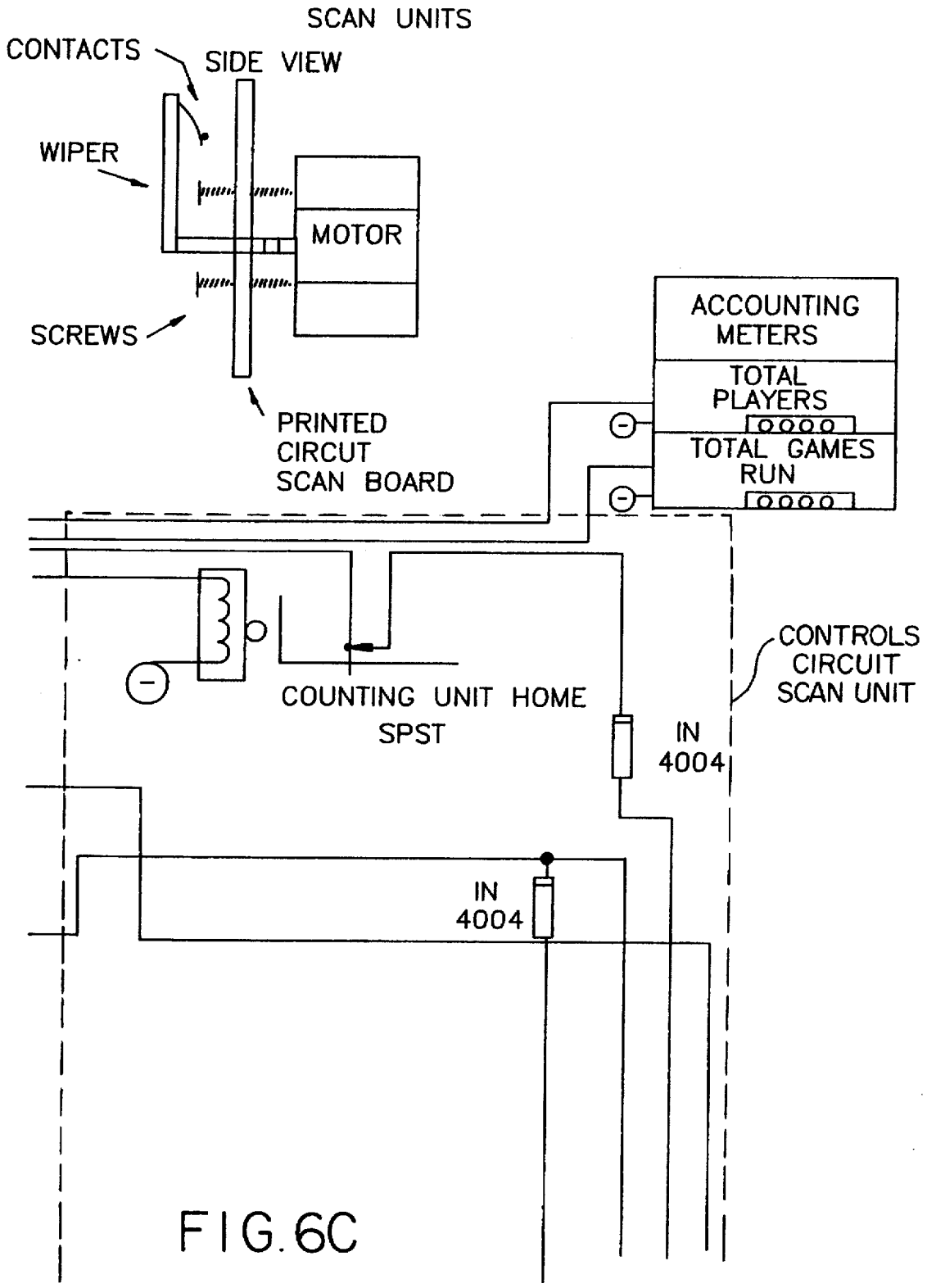
Figure 6D:
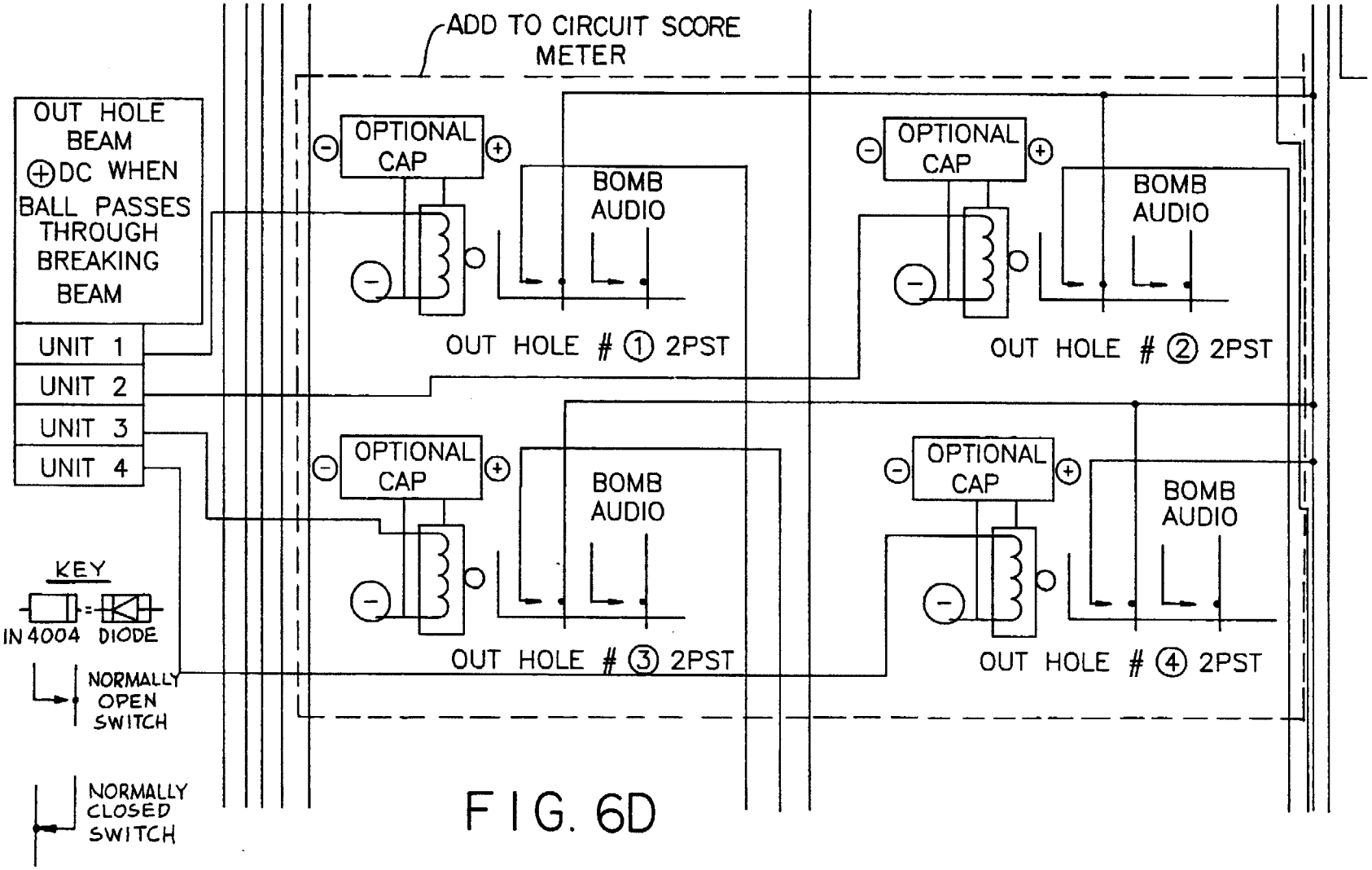
Figure 6E:
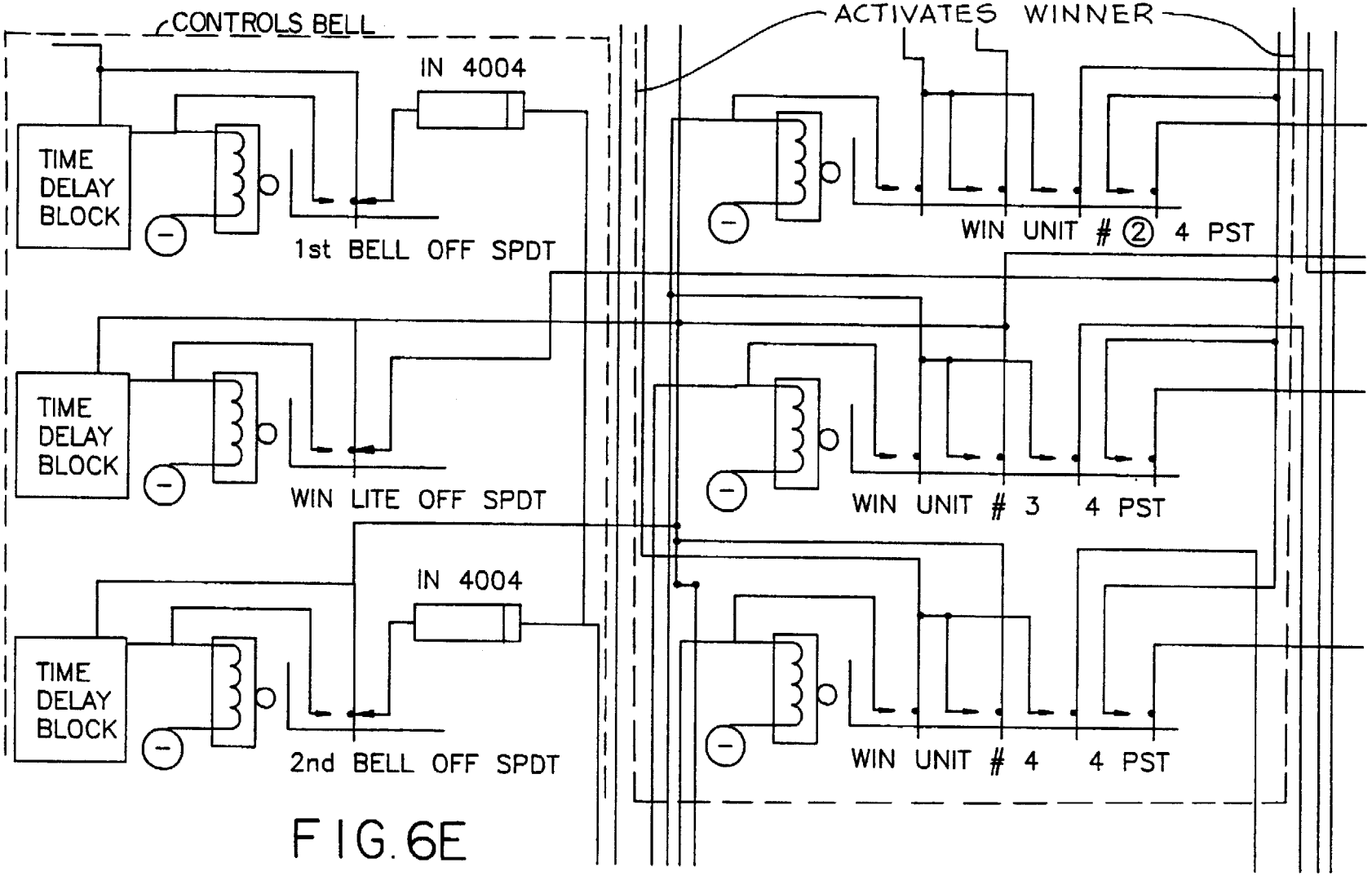
Figure 6F:
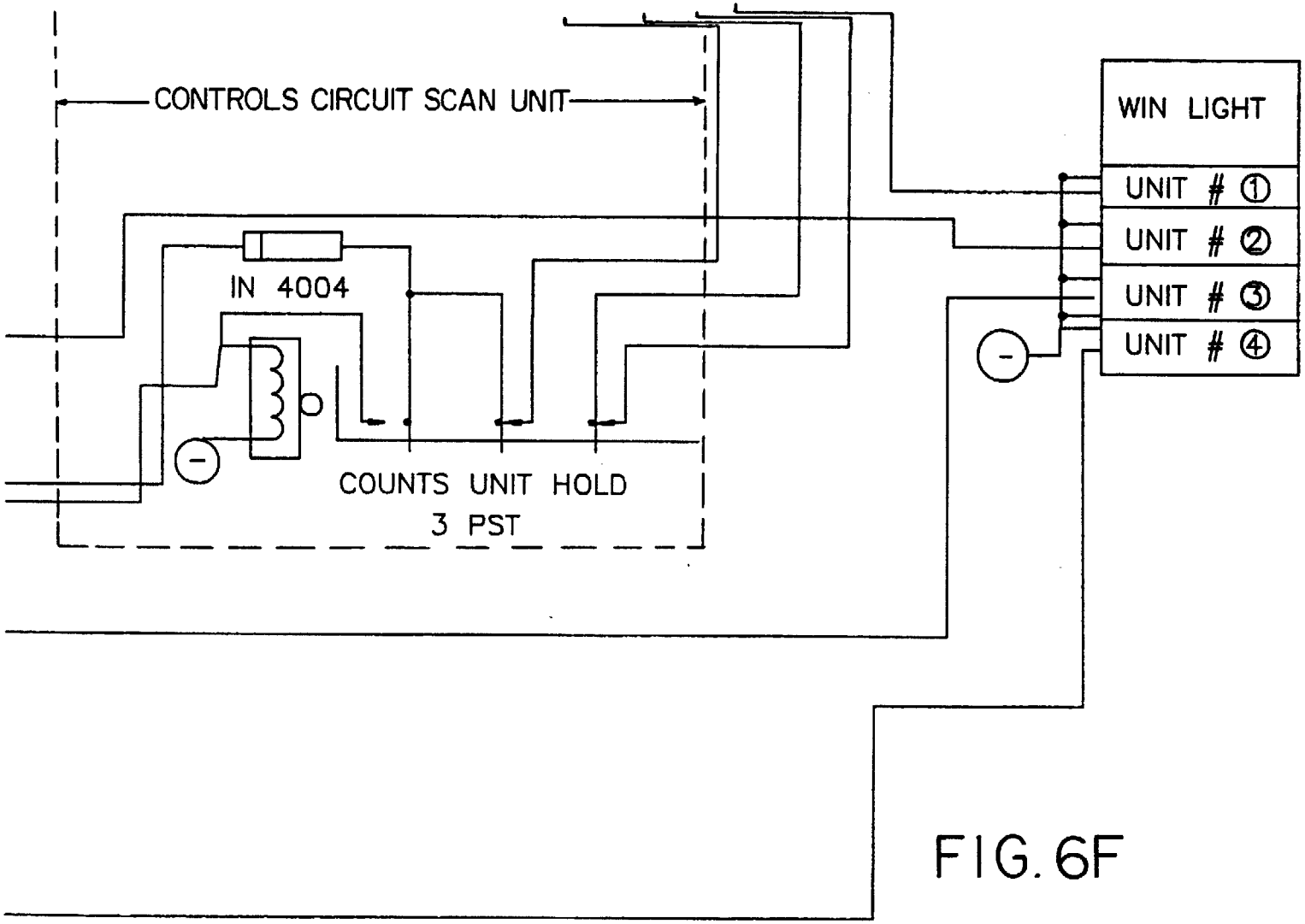
Figure 6G:
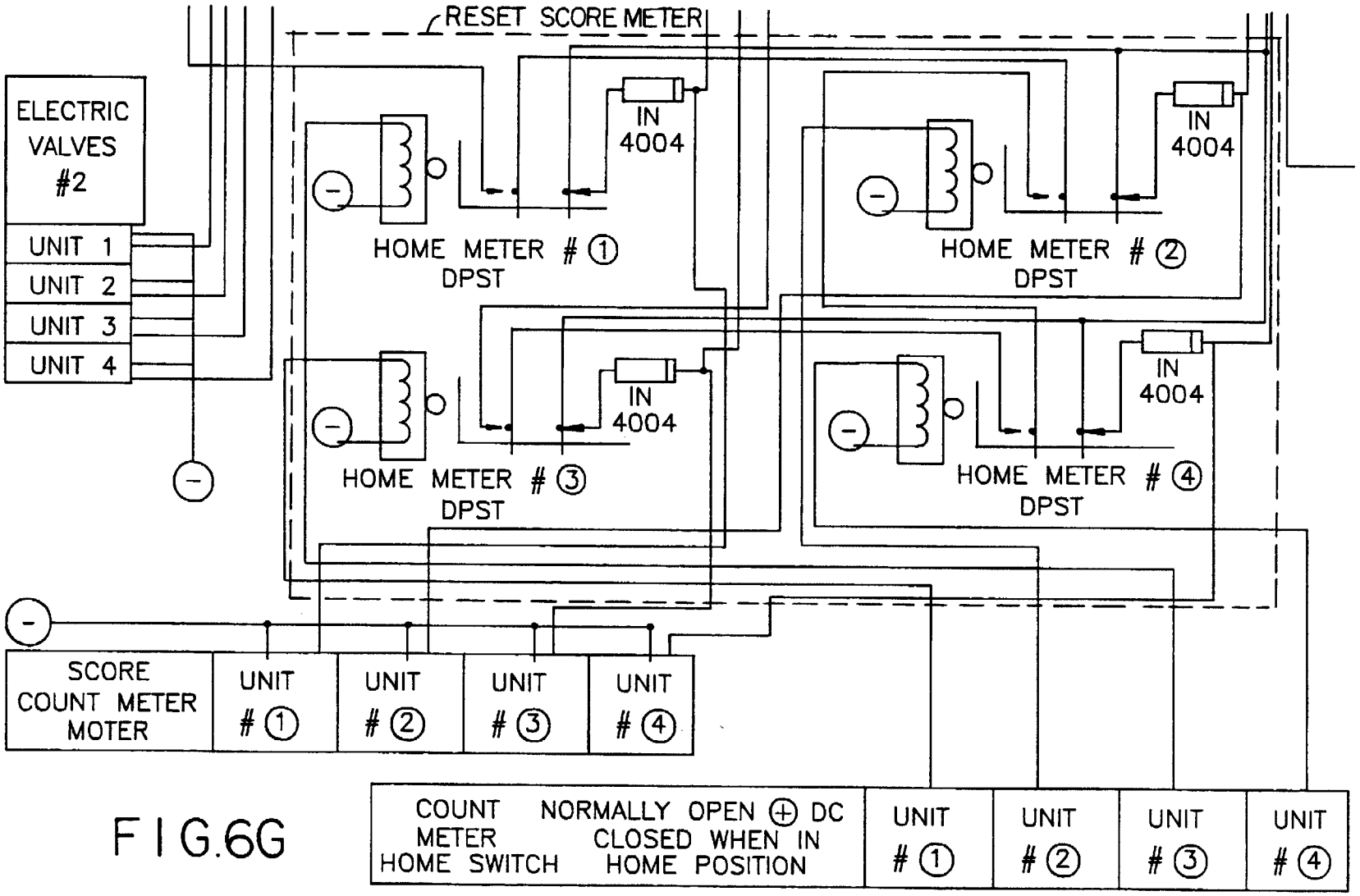

FIGS. 6C and 6F, illustrate the controls for the Count Scan Unit.

FIG. 6D shows the circuit which adds to the Count Score Meter. This is activated by a ball interrupting a light beam at the bottom of the toilet bowl. As shown in FIGS. 6B and 6, when a predetermined number of balls are thrown into a toilet bowl by a player before others are designated as the winner, the winner circuits are activated.

Figure 6H:
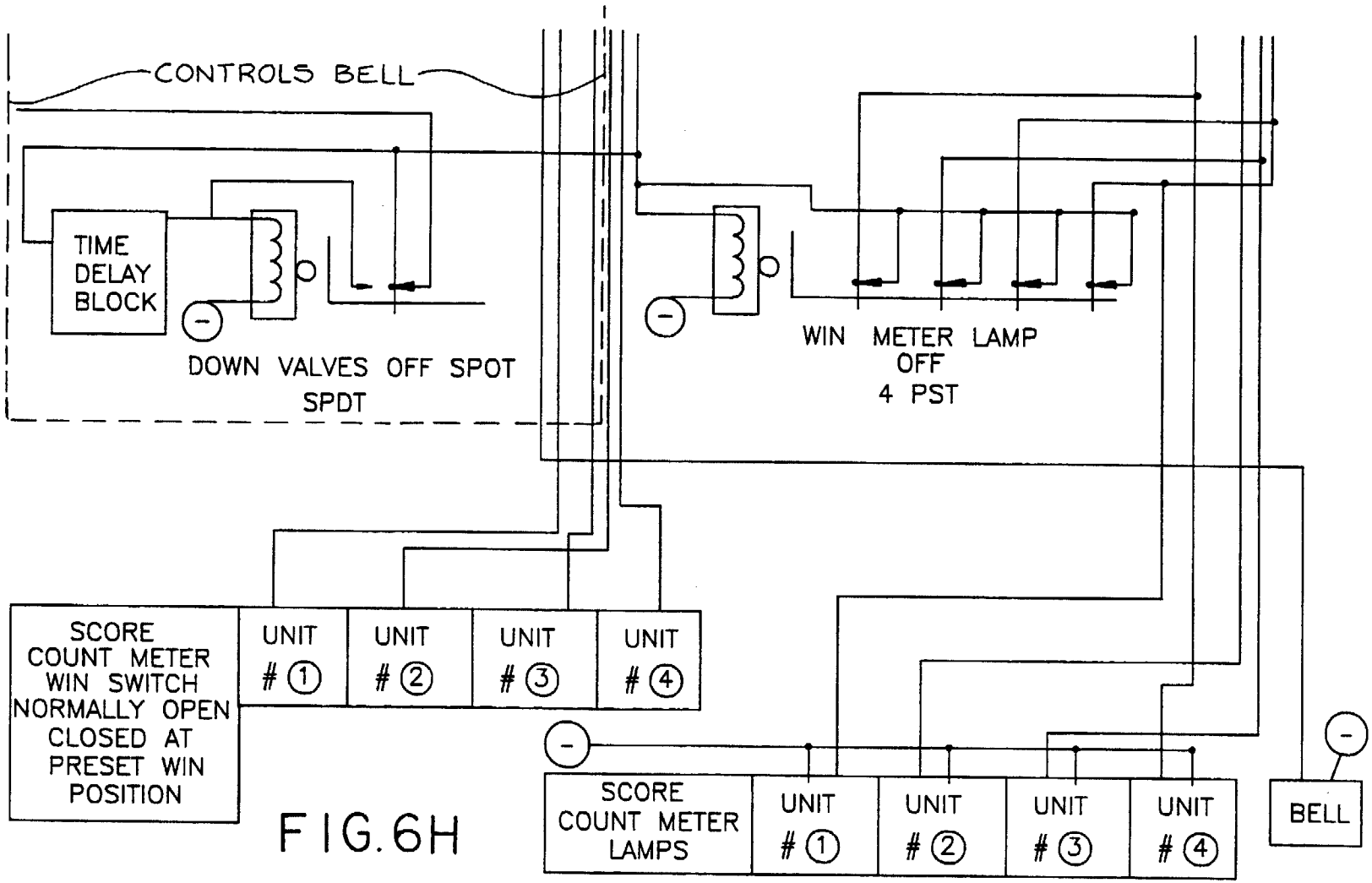
Figure 6I:
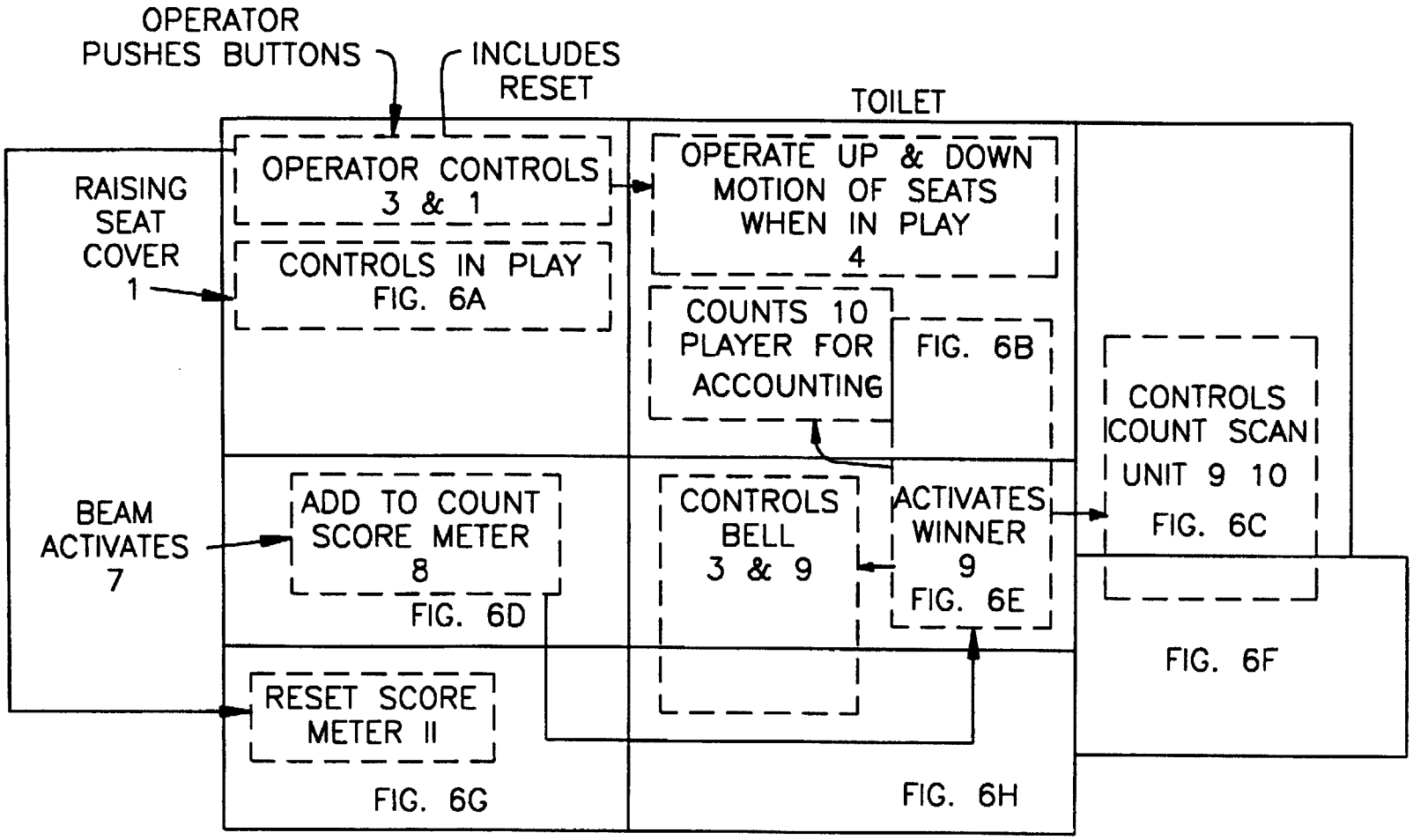
Figure 7B:
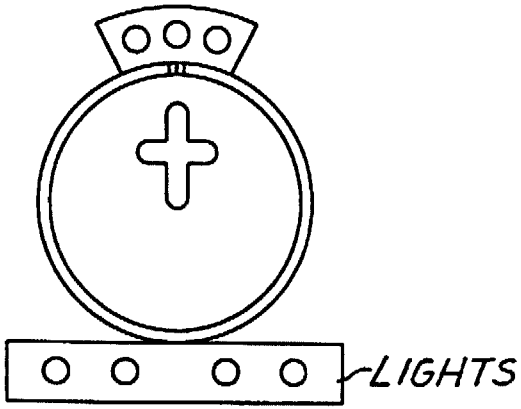
FIGS. 7A to 7D are detail of the scoring indicator.
Figure 7D:
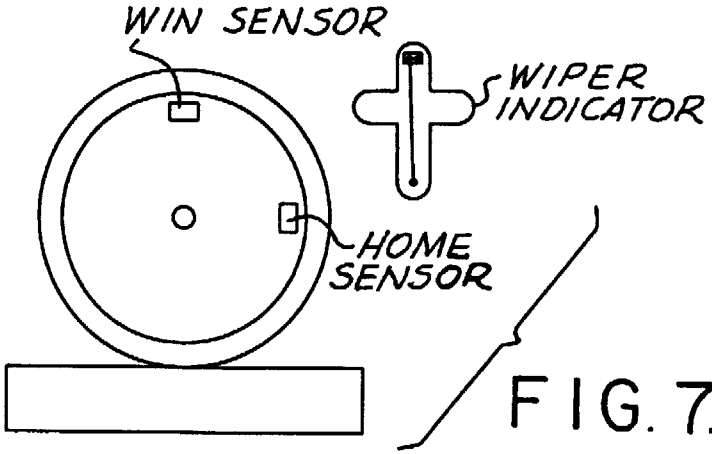
Figure 7A:
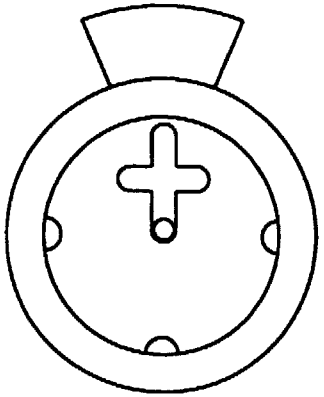
Figure 7C:
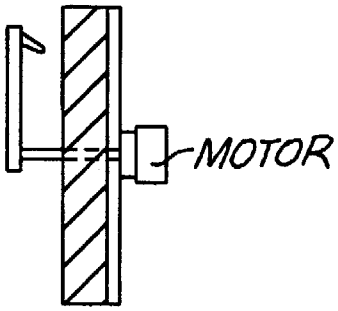

The Winner circuit initiates a bell sequence, as seen in FIGS. 6E and 6H.

What I claim is:

1. An arcade game played by a plurality of participants under control of an operator comprising:

a) a front counter having a plurality of stations;

b) a target positioned, approximately three (3) to ten (10) feet directly in front of each station, having a simulated toilet bowl seat and toilet bowl cover having a forward and an inward end, moved by push rods at the inward end of the toilet bowl cover, with means to cause said toilet bowl seat to alternatively pivot up and down; with means to cause the toilet bowl cover to fall when the game is commenced;

c) a plurality of balls, such that they are thrown by the participant into the toilet bowl which is in front of each station;

d) a means of returning said balls to a ball access return compartment at each station of the front counter; each ball access compartment being open such that the participant can reach for balls;

e) a means of opening and closing the ball access return compartment for each station at the beginning and end of the game;

f) a means of detecting the balls passing through an opening in the bottom of the toilet bowl in front of each station;

g) a means of counting the number of balls each participant throws into each of their respective bowls;

h) a means of setting at what predetermined winning number of balls constitutes a winning situation by the first participant to reach that number;

i) a means of determining when the predetermined winning number of balls is thrown into a toilet bowl;

j) an accounting means counting the number of participants in each game;

k) a means of creating audio when a game is started and a winner is determined;

l) a means of resetting the game after a winner is determined which closes the toilet seats and sets each means of ball counting back to zero.

* * * * *